US007961072B2

(12) United States Patent
Pilniak et al.

(10) Patent No.: US 7,961,072 B2
(45) Date of Patent: Jun. 14, 2011

(54) INDUCTIVE ELEMENT

(75) Inventors: Jurgen Pilniak, Warstein-Allagen (DE); Peter Wallmeier, Lippstadt (DE)

(73) Assignee: DET International Holding Limited, Grand Cayman (KY)

( * ) Notice: Subject to any disclaimer, the term of this patent is extended or adjusted under 35 U.S.C. 154(b) by 450 days.

(21) Appl. No.: 11/897,814

(22) Filed: Aug. 31, 2007

(65) Prior Publication Data

US 2008/0068120 A1 Mar. 20, 2008

(30) Foreign Application Priority Data

Sep. 1, 2006 (EP) ..... 06405376

(51) Int. Cl.
*H01F 27/28* (2006.01)
*H01F 27/24* (2006.01)
*H01F 7/06* (2006.01)

(52) U.S. Cl. ..... 336/180; 336/212; 29/602.1; 29/605; 29/606

(58) Field of Classification Search ..... 336/180, 336/212; 29/602.1, 605, 606; 242/433.2, 242/443, 600, 613.5
See application file for complete search history.

(56) References Cited

U.S. PATENT DOCUMENTS

| | | | | |
|---|---|---|---|---|
| 1,501,649 | A * | 7/1924 | Cummings | 336/120 |
| 2,776,413 | A * | 1/1957 | Knouse | 336/192 |
| 2,814,732 | A * | 11/1957 | McFarland | 290/30 R |
| 3,548,356 | A | 12/1970 | Wright | |
| 4,118,678 | A * | 10/1978 | Goshima et al. | 333/185 |
| 4,326,182 | A | 4/1982 | Klaus | |
| 6,087,920 | A * | 7/2000 | Abramov | 336/192 |
| 6,525,635 | B2 * | 2/2003 | Murata et al. | 336/83 |
| 6,950,002 | B2 * | 9/2005 | Sano | 336/83 |
| 2002/0190832 | A1 * | 12/2002 | Amada et al. | 336/192 |
| 2004/0150500 | A1 * | 8/2004 | Kiko | 336/90 |
| 2005/0258926 | A1 * | 11/2005 | Weger | 336/212 |
| 2005/0285708 | A1 * | 12/2005 | Berens et al. | 336/212 |

FOREIGN PATENT DOCUMENTS

| | | | |
|---|---|---|---|
| EP | 0 684 616 | A1 | 11/1995 |
| GB | 245 537 | A | 1/1926 |
| JP | 62125609 | A * | 6/1987 |
| JP | 01 181 403 | A | 7/1989 |
| JP | 02271511 | A * | 11/1990 |
| JP | 10040832 | A * | 2/1998 |

* cited by examiner

*Primary Examiner* — Lincoln Donovan
*Assistant Examiner* — Tszfung Chan
(74) *Attorney, Agent, or Firm* — Venable LLP; Robert S. Babayi; Christopher Ma

(57) ABSTRACT

An inductive element comprises at least two core-parts including a magnetically permeable material and at least one winding of an electrical conductor which can be a foil winding, a stranded wire (litz) winding or a conventional wire winding. Each core-part has an elongated center piece with an outer winding surface. At each of its longitudinal ends, the center piece has a contact element with a lateral contact surface. The winding is wound directly on the core-parts without a bobbin or the-like. The core-parts of the inductive element are arranged with their longitudinal axes essentially in parallel in a manner that the lateral contact surfaces of each contact element abut on a lateral contact surface of another core-part. Such an inductive element can be manufactured by co-axially arranging the core-parts and using them as a roll-shaft. After the windings have been applied to the core-parts, they can be rearranged, i.e. "flipped over," in a stack-like arrangement in order to form an inductive element.

9 Claims, 4 Drawing Sheets

INDUCTIVE ELEMENT

CROSS REFERENCE TO RELATED APPLICATIONS

This application claims priority from the European patent application No. 06 405 376.2 filed Sep. 1, 2006 in the name of DET International Holding Limited entitled "Inductive Element," incorporated herein by reference.

FIELD OF THE INVENTION

The invention relates to an inductive element and a method of making an inductive element, wherein the inductive element comprises at least two core-parts, where the core-parts include a magnetically permeable material. More particularly the invention relates to an inductive element and method utilizing modular core parts and absent a bobbin.

BACKGROUND

Common designs for high power inductors and chokes used in switching mode applications have constructions incorporating coils with bobbins for carrying the windings and isolating them from a permeable core. The core, which is typically manufactured with assemblies comprising U-shaped core-parts, thereby acts as a magnetic flux path. The two U-shaped core-parts then are arranged adjacent to each other, abutting on front side contact surfaces of their legs. One or more bobbins are accommodated on one or on two oppositely situated legs of the core-parts. Inductive elements of such a design are commonly manufactured by sliding prefabricated coils onto the legs of the core-parts. The coils thereby comprise a bobbin carrying the winding of the coil usually having a supporting and an isolating function. The core-parts are usually combined in a way that the contact surfaces abut on each other inside the coil bobbins thus forming air gaps inside the bobbins.

Such designs have several disadvantages. The winding window introduced by the bobbin results in a less than ideal copper fill factor. The winding windows of bobbins are particularly disadvantageous since the bobbins have to be manufactured with comparatively large tolerances in order to avoid difficulties during assembly of the inductive element, i.e. inserting the legs of the core-parts into openings of the bobbin. Besides the bad copper fill factors the large tolerances also may be responsible for vibrations of the coils. Another significant disadvantage of the use of a bobbin is a high thermal resistance between core and winding due to the thermal insulating properties of the bobbin material.

The U.S. Pat. No. 4,326,182 describes a U-core transformer having bobbins molded directly on the U-shaped core-parts outside the region where the core-parts contact each other. While improving the above mentioned standard transformer design, the U.S. Pat. No. 4,326,182 still uses bobbins for carrying the winding. Moreover, the method of manufacture for such a transformer is complex and involves the step of molding a bobbin onto the core and handling the U-shaped core-parts, which are non-symmetric with respect to the winding axis, when performing the winding process.

BRIEF DESCRIPTION

In accordance with a first aspect of the invention, an inductive element is made up of several core-parts. Each core-part has a center piece with opposite ends defining a longitudinal axis of the core-part with respect to which the center piece has an outer surface. The outer surface of the center piece forms a winding surface and each core-part has a contact element at each of opposite longitudinal ends of its center piece. Each contact element thereby has a lateral contact surface formed on an outer surface of the contact element relative to the longitudinal axis of the core-part, where the inductive element comprises a winding of an electrical conductor and the contact surface of each contact element abuts on a lateral contact surface of another core-part.

In accordance with a second aspect of the invention, the invention further relates to a method of manufacture of an inductive element comprising at least two core-parts with each having an elongated center piece with an outer winding surface and in particular an inductive element according to the first aspect of the invention.

The invention also relates, in a third aspect, to a core-part for an inductive element, in particular for an inductive element according to the first aspect of the invention and for the use in the method according to the second aspect of the invention, including a magnetically permeable material and having a center piece, where the center piece has opposite ends defining a longitudinal axis of the core-part with respect to which the center piece has an outer surface, a contact element at each of the opposite longitudinal ends of the center piece and the outer surface of the center piece forming a winding surface, and where each contact element of the core-part has a lateral contact surface formed on an outer surface of the contact element with respect to the longitudinal axis of the core.

It is an object of the first aspect of the invention to provide an inductive element pertaining to the technical field initially mentioned which is efficient and has a modular assembly that is simple to manufacture. It is another object of the invention, in accordance with the second aspect, to provide a method of manufacture that allows for an efficient and simple manufacture of an inductive element, particularly an inductive element according to the first aspect of the invention. In a third aspect of the invention, a core-part for an inductive element is provided, particularly a core-part for an inductive element according to the first aspect of the invention and for use in the method according to the second aspect of the invention.

According to the first aspect of the invention, the inductive element comprises at least two core-parts including a magnetically permeable material. Each core-part has a center piece and the center piece has opposite ends defining a longitudinal axis of the core-part. The center piece has an outer surface with respect to the longitudinal axis which forms a winding surface for receiving a winding. Further, each core-part has a contact element at each of the opposite longitudinal ends of the center piece and the contact elements have an outer surface with respect to the longitudinal axis. Each contact element has a lateral contact surface formed in an area of the outer surface. The inductive element further comprises a winding of an electrical conductor. The core-parts are thereby arranged in a manner that the lateral contact surface of each contact element abuts on a lateral contact surface of another core-part. According to the invention, the winding of the electrical conductor is wound directly on the winding surface of a core-part. The core-parts of the inductive element are preferably arranged with their longitudinal axes essentially in parallel.

Note that, as used herein, "Winding directly on the winding surface" refers to the fact that an inductive element according to the invention does not need a coil former, bobbin or the-like. "Directly" does not preclude the presence of electrically insulating means between the winding and the possibly electrically conducting core-parts. For example, insulating means can be formed by an insulating coating of the electrical conductor or can comprise wrapping a thin insulating foil around the winding surface of the center pieces prior to winding the electrical conductor on it. Further, "abutting" of the contact surfaces generally refers to an adjacent arrangement of the contact surfaces in close proximity and does not necessarily mean that the contact surfaces are in physical contact. In particular, "abutting" herein also includes the presence of an air-gap between the contact surfaces. Besides the inevitable air-gap occurring due to irregularities on the contact surfaces, it is also a part of the invention that an air-gap can be deliberately left between core-parts in order to produce a controlled magnetic stray field if, for example, the inductive element is to be used as a choke. In other embodiments, however, the abutting contact surfaces can be in physical contact.

According to the second aspect of the invention the method of manufacture is provided that allows for an efficient and simple manufacture of an inductive element according to the first aspect of the invention. In accordance with the method of manufacture of an inductive element of the second aspect of the invention, at least two core-parts with each having an elongated center piece with an outer winding surface are provided, and the method comprises the steps: a) arranging the core-parts next to each other with their longitudinal axes co-axially aligned; and b) performing a winding process in which an electrical conductor is wound on a winding surface of one or more of the co-axially aligned core-parts.

In accordance with the third aspect of the invention, a core-part for an inductive element a) is of a magnetically permeable material, b) having a center piece, c) the center piece having opposite ends defining a longitudinal axis of the core-part with respect to which the center piece has an outer surface, d) a contact element at each of the opposite longitudinal ends of the center piece, e) the outer surface of the center piece forming a winding surface, f) each contact element of the core-part having a lateral contact surface formed on an outer surface of the contact element with respect to the longitudinal axis of the core-part, and is characterized in that g) the core-part has a frontal contact surface for the co-axial arrangement with another core-part at each of its longitudinal ends.

An inductive element according to the invention can comprise an arbitrary number of core-parts. Due to the absence of a bobbin or similar coil forming means the core-parts can be freely formed and have no restrictions concerning the ability to be inserted into an opening of a bobbin or the-like. The core-parts of an inductive element according to the invention can therefore comprise arbitrarily shaped components that are not determined by constraints arising from a bobbin but can rather be formed in a way most suited for the corresponding purpose. Particularly, the core-parts can comprise contact elements with an optimized shape symmetrically protruding over the center piece with respect to the longitudinal axes of the core-parts for providing good thermal contact means between core-parts and/or for providing mounting means. The contact elements can be formed in a way to allow for a modular combination of an arbitrary number of core-parts. The core-parts can be arranged in a straight stack or can be bundled.

The modular construction of an inductive element according to the invention also allows for manufacture of the core-parts with a winding as independent units. Pre-manufactured core-parts can then be combined in an inductive element according to the invention in order to form a closed magnetic circuit with an arbitrary number of core-parts. Different designs of transformers, for example, can thereby be realized by combining a number of essentially identical core-parts. The design of an inductive element according to the invention is no longer restricted by a given shape of the core-parts as such as two C-shaped core-parts that can only be combined into an O-shaped closed magnetic circuit as it is known from the prior art. An inductive element according to the invention can be designed as a double C-shaped or an H-shaped transformer by combining two or three essentially identical core-parts. Further layouts of an inductive element can be realized by combinations of arbitrary numbers of core-parts.

Another advantage of an inductive element according to the invention is a minimized thermal resistance between the core-parts and the winding. According to the invention no bobbin or coil former is needed. The function of the bobbin, i.e. carrying or supporting the winding, is achieved by the core-part itself without the need of any additional parts. Therefore, no space taking intermediate layer between the winding and the core-part is needed. The winding can be tightly wound onto the winding surface of the center piece without introducing a spacing between core-part and winding. Only an electrical insulation between winding and core-part has to be provided. This can be realized by a very thin electrical insulation layer applied either on the conductor of the winding or between winding and core-part. Due to the close contact between the electrical conductor of the winding and the core-part it is therefore possible to achieve an excellent rate of heat transfer between winding and core-part. Moreover, by bringing neighboring core-parts into contact via their contact surfaces, heat i.e. thermal energy is exchanged between the core-parts, allowing for an even distribution of thermal energy among the different core-parts. In the context of high power applications, heat transfer i.e. heat dissipation is a significant constraint in the design of inductive elements as chokes or transformers. It is therefore highly desirable to create inductive elements that can distribute and transfer thermal energy efficiently from a winding, where heating occurs, to core-parts and perhaps to heat dissipation devices attached hereto.

According to the invention, the core-parts are made from a magnetically permeable material. Thereby, the core parts not only provide means for distributing and dissipating thermal energy, they also serve as magnetic flux-paths. The absence of a bobbin therefore also provides for an excellent copper fill factor in the winding window due to the tight attachment of the winding to the core-part material.

In one preferred embodiment, an inductive element according to the invention has at least one further winding. There is no restriction in the number of windings that can be included in an inductive element according to the invention. It is possible to have an inductive element that comprises a primary and a secondary winding, forming a basic transformer. It thereby is possible that each winding is wound onto a separate core-part. This has the advantage that the core-parts including the winding are disconnected parts and can therefore be freely handled, arranged and possibly rearranged without restrictions. It is also possible, that more than one winding is wound onto one single core-part or that one winding extends over several core-parts.

Alternatively, an inductive element according to the invention may have only one winding and two core-parts forming a simple inductive element with a closed magnetic circuit.

Preferentially, in a preferred exemplary embodiment the inductive element has at least two windings connected in series. The windings can be wound on separate core-parts and can be connected in a series arrangement. Also, according to a preferred exemplary embodiment of the invention, it is possible that one winding is extended over several core-parts by the electrical conductor forming the winding being lead from one core-part to a further, neighboring core-part and even continuing the winding on further core-parts.

Alternatively, the inductive element may have two or more windings that are not electrically connected.

In a preferred embodiment, the electrical conductor of the winding is an electrically conductive foil. A foil has the advantage of allowing higher current strengths than conventional wire windings. Foil windings therefore are the preferred embodiment for high power applications with high current densities inside the windings of the inductive element. The winding is in that case formed by wrapping a metal foil layer around the winding surface of the core-part. In another preferred embodiment, the winding may be made from stranded wire (litz wire). Compared to conventional wire windings stranded wire has the advantage of being versatile and simple to be applied to the core-parts during the winding process. A tight attachment of the stranded wire to the winding surface of the core-part can be achieved by applying a certain tension to the stranded wire during the winding process. Due to its flexibility, the stranded wire tightly wraps around the contact surface. Thereby a close thermal contact between winding and core-part can be ensured.

Alternatively, the winding can be provided by a conventional wire. Conventional wire has the disadvantage that a rather large diameter of the wire is required to carry the current strengths in high power applications. Such a wire is comparably rigid and it is difficult to wind it on the core-parts. Due to its rigidity it is generally harder with a conventional wire to achieve a tight attachment to the core-parts compared to windings with, say, a stranded wire.

In a preferred embodiment of the invention, the center piece of a core-part has a cross section with circular circumference in a transversal plane to the longitudinal axis of the core-parts. The circular circumference allows for a tight and constant attachment of winding and core-part, resulting in an improved copper fill factor and a good and even thermal contact between winding and core-part. During manufacture, a circular circumference of the center piece facilitates the tight winding of the electrical conductor. Due to the constant curvature of the circular shape, the tension or force that needs to be applied to the conductor in order to ensure tight and even attachment to the winding surface can therefore be held constant during the winding process. In contrast, when having a multi-edged cross-section of the center piece, the forces or tensions peak when the conductor is bent around the corners, thus complicating the winding process.

In an alternative, the center piece can also have a cross section with, for example, a quadratic circumference with rounded corners. Such an embodiment has the disadvantage that the radius of the corners has to be chosen large enough to ensure tight attachment between the electrical conductor of the winding and core-part material. The optimal radius for the corners thereby depends on the material properties of the electrical conductor and the design is also more difficult to manufacture.

In a preferred embodiment, the core-parts are formed from one piece. Particularly, the contact elements and the center piece of a single core-part are formed from one piece. Alternatively, it is also possible that the core-part comprises several parts such as a center piece with the contact elements attached hereto. A multi-pieced core-part however can complicate the manufacture of the core-part. The core-part is preferentially formed from ferrite. Alternatively, any magnetically permeable material can be used as material for a core-part. In a preferred embodiment, the core-part is formed from one single piece of ferrite but it is also possible to form the core-part from separate parts.

In another preferred embodiment of the invention the center piece of a core-part has a groove in its winding surface that extends in longitudinal direction. The groove can extend over the whole length of the center piece. The groove has a cross section that allows for receiving a part of the electrical conductor of the winding. Thereby, a portion of the electrical conductor used for the winding, the winding start portion, can be guided inside the groove from one longitudinal end to the other end of the winding space. Such a design has the advantage that the part of the electrical conductor being guided inside the groove is held and secured in place by the turns of the winding itself. The groove can also extend from one frontal end portions of the core-parts to the other, possibly extending from the winding surface into the contact elements. It is also possible, that the contact elements of the core-parts have longitudinal through-holes, recesses or grooves that allow the electrical conductor to be guided from the frontal portions of the core-parts through or along the contact elements to the groove or to the winding surface of the center piece. The great advantage of such a design is that the winding can still be tightly attached to the winding surface of the core-part while both ends of the electrical conductor of the winding can be guided to the same longitudinal end of the core-part without the need for additional fixing means to fix loose portions of the electrical conductor.

Alternatively, the center piece has no groove in its winding surface. It is still possible to lead both ends of the electrical conductor to the same longitudinal end of the core-part by leading one end outside the winding from one end in longitudinal direction to the other end of the core-part or the winding surface, respectively. Thereby, the loosely guided part of the electrical conductor requires additional fixing means and is not held in place by the winding itself.

In a preferred embodiment of the invention, the lateral contact surfaces of the contact elements of the core-parts are flat surfaces. Flat surfaces have the advantage that they are easy to manufacture and the core-parts can easily be combined. In particular, flat contact surfaces allow the free combination of all contact surfaces with each other. Alternatively, the contact surfaces can have a profiled surface. Whereas such an embodiment may have advantages when aligning the core-parts, profiled surfaces are more difficult to manufacture and cannot be freely combined since only complementary surfaces can form a good thermal or magnetic contact when abutting on each other.

In a further preferred embodiment of the invention, the contact elements of a core-part have each two contact surfaces formed on its outer surface with respect to the longitudinal axis of the core-part. The contact surfaces thereby are symmetrically arranged opposite to each other with respect to the longitudinal axis of the at least one core-part. In particular, in the case of flat contact surfaces, the contact surfaces are orientated in parallel. In case of profiled contact surfaces, the oppositely arrange contact surfaces have complementary profiles.

Alternatively, it is also possible that the lateral contact surfaces are not flat and/or they are not parallel orientated. It is possible that the contact elements have regular polygonal, for example, triangular or hexagonal, cross-section in a plane perpendicular to the longitudinal axis of the core-part. The sides of the polygons are thereby formed by the intersection of the cross sectional plane with the lateral contact surfaces of the contact element. In this case, the lateral contact surfaces have an angle of 60° or 120°, respectively, between them. It is also possible that none of the core-parts has two oppositely arranged contact surfaces on a single contact element. In the case of an inductive element with more than two core-parts the core-parts can then not be arranged in a straight stack.

In a preferred embodiment of the invention, the contact elements of the core-parts have a rectangular cross-section in a plane perpendicular to the longitudinal axis of the core-part. Thereby, the rectangle has shorter and longer sides wherein the shorter sides of the cross section are a result of the intersection of the plane of the cross-section with the contact surfaces of the contact element. In particular, the longitudinal axis of the center piece goes through the balance point of the rectangle i.e. the intersection of the diagonals. The contact elements are therefore symmetric with respect to planes comprising the longitudinal axis of the core-part and being parallel to two sides of the circumference of the cross-section on the one hand and being perpendicular to the two further sides of the circumference. In a possible embodiment, the length of the shorter sides corresponds to a diameter of the cross section of the center piece whereas the long sides are preferentially larger. In particular, relative to a winding of a core-part, the longer sides are longer than an outer diameter of the winding.

Alternatively, the contact elements can have a hexagonal cross section. The contact elements are then more difficult to manufacture than in an embodiment with the simple rectangular cross section.

In another preferred embodiment, a core-part has a further lateral contact surface on each contact element that does not abut on a lateral contact surface of another core-part. The contact elements with the additional lateral contact surfaces thereby can serve as mounting stand-offs allowing for attachment of the inductive element to any mounting surface having corresponding contact surfaces. The mounting surface can thereby be a housing or a heat dissipating element, such as a heat-sink device, or other parts for attaching the inductive element to. The heat-sink can be an external element where the inductive element is attached to or can be a part of the inductive element itself. It is also possible that more than one or all of the core-parts have further contact surfaces on its contact elements that can serve as attaching means for the attachment of the inductive element to additional elements such as mounting surfaces or other parts. In particular, it is also possible that more than one core-part of the inductive element is attached to a heat-sink device.

In an alternative embodiment, none of the core-parts may have additional lateral contact surfaces that allow for attachment to a mounting surface. In this case additional mounting means may be used to attach the inductive element to a heat-sink or any mounting surface.

The method according to the invention is particularly useful for the manufacture of an inductive element according to the first aspect of the invention. By co-axially arranging the core-parts next to each other, the parts together form a shaft that can be rotated around its longitudinal axis which corresponds to the essentially common longitudinal axis of the core-parts. The thus-arranged core-parts can therefore serve as a single roll-shaft during the winding process. The core-parts can be held in this arrangement by applying pressure in the direction of the longitudinal axis of the thus formed shaft. They also can be combined by other means in order to form a rugged shaft that is capable of withstanding the forces arising during the winding process.

When rotating the thus-arranged core-parts, i.e. the roll shaft, around their common longitudinal axis in order to perform the winding process, an electrical conductor can be wound simultaneously on each core-part, thus significantly reducing the time needed to produce the windings for the inductive element. The conductor can also be sequentially wound on each core-part. Sequential winding of the windings on each core-part has the advantage that the winding sense of the windings with respect to the winding axis can be chosen separately for each winding by rotating the roll-shaft accordingly.

By winding the conductor directly on the winding surface of the core-parts, a bobbin or the-like is made obsolete, resulting in a less complicated production process and greatly reduced production time. Particularly, it does not require further supporting means for the winding that would introduce unwanted spacing between the winding and the core-parts which in turn would reduce the efficiency of the inductive element. Time consuming processing steps as e.g. slipping the bobbin of a coil or a prefabricated bobbin-less coil onto a core-part before rearranging them are also made obsolete. Thus, the production time of the inductive element is significantly reduced and simplified.

The winding process of the method according to the invention preferentially comprises the steps of winding a winding from a continuous electrical conductor directly on the winding surface of a core-part, leading the continuous electrical conductor to the winding surface of another core-part and then continuing the winding by winding the continuous electrical conductor on the winding surface of the other core-part. This advantageous method allows for a fast and efficient method of forming core-parts with a winding. The electrical conductor can thereby left continuous or it can be cut in the portions of the conductor leading from the winding of one core-part to the winding of another core-part thus disconnecting the single core-parts.

The winding sense of the single windings can be chosen by applying the according sense of rotation of the roll-shaft. This is of particular relevance when the wire is continuous and the core-parts are not separated entirely, i.e. the wire between core-parts is not cut.

Preferentially, a single feeding device for the electrical conductor guides the conductor to the winding spaces of the core-parts. Starting at one of the longitudinal ends of the shaft-like arranged core-parts, the winding process is then performed and the feeder is moved from one longitudinal end of the shaft-like arranged core-parts to the other longitudinal end.

Alternatively, a winding is wound simultaneously on several core-parts. In this case the method requires for several feeding devices in order to lead the electrical conductor during the winding process. The electrical conductor thereby has to be discontinuous and possible desired electrical connections between different windings have to be formed in an additional step by connecting the end portions of the windings.

Preferentially, the winding process of the method comprises leading the electrical conductor inside a longitudinal groove in the winding surface of the center piece of at least one core-part. The groove is formed in the winding surface of the center piece parallel to the longitudinal axis of the core-part. The groove can thereby extend over the whole length of the center piece or only a part of the whole length. The electrical conductor is lead inside the groove from one end to the other end of the groove prior to performing the winding process. When performing the winding process, the electrical conductor is secured inside the groove and held in place by the turns of the winding itself. Without a groove in the winding surface, the electrical conductor could also be led from one end to the other end of the winding surface prior to performing the winding process and then be secured by winding the electrical conductor over it. In this case, the close attachment of the winding to the core-part, i.e. its winding surface, would be disadvantageously disrupted by the electrical conductor lying between the core-part and the turns of the winding thus greatly reducing the efficiency of the inductive element. Alternatively, a portion of the winding can also be loosely guided outside the winding along the core-part from one end to the other. This then has the disadvantage mentioned above that the portion of the winding is then not held in place by the turns of the winding.

Preferentially, the core-parts used in the method according to the invention have a contact element at each of the opposite longitudinal ends of their center piece and each contact element has a lateral contact surface formed on an outer surface of the contact element. The outer surface thereby is an outer surface with respect to the longitudinal axis of the core-part. The method then comprises, after the step of performing the winding process, the further steps of arranging the core-parts with their longitudinal axes essentially parallel, in a way that the lateral contact surface of each contact element abuts on a lateral contact surface of another core-part. In particular, after the winding process has been performed, the shaft-like arranged core-parts are separated i.e. the roll shaft is disassembled. "Separating" or "disassembling" hereby does not preclude the further presence of a connection of the core-parts by a portion of a continuous electrical conductor. The separated core-parts can then simply be flipped over in the sense of changing the relative orientation of their axes from parallel to anti-parallel in order to bring their contact surfaces into contact in the above described manner. The process of rearranging the core-parts thus involves a translation and a rotation of one core-part with respect to another.

Alternatively, the lateral contact surfaces can be brought into the above described abutment by maintaining the relative orientation of the axes as they were in the co-axial arrangement. The rearrangement of the core-parts then only involves a translation of a core-part with respect to the other.

The core-parts can also have front surfaces on its longitudinal ends and the step of arranging the core-parts in a shaft-like arrangement with their longitudinal axes essentially co-axially aligned then preferentially comprises arranging neighboring core-parts with their facing front surfaces abutting on each other. The front surfaces thereby form frontal contact surfaces and can be either flat or profiled. Preferentially, they are flat in order to provide frontal contact surfaces that are on the one hand complementary and on the other hand can be freely combined. In case of profiled front surfaces, the abutting surfaces preferentially have complementary profiles in order to maximize the contact area. "Abutting" here refers to a significant portion of the front surface area between two neighboring core-parts forming a contact area. Profiled frontal contact surfaces in general have the disadvantage that they cannot necessarily be freely combined anymore.

The step of arranging the core-parts with their longitudinal axes essentially co-axially aligned preferentially comprises the further step of arranging coupling pieces between neighboring core-parts. Arranging an additional coupling piece between the core-parts has the advantage that the co-axial arrangement can be achieved independently from the presence and/or the design of the front surfaces of the core-parts. The coupling pieces can be formed corresponding to the shape of longitudinal end portions of the neighboring core-parts, allowing for a co-axial arrangement of the core-parts independently from the actual shape of the end portions or the presence of front surfaces. When the shaft-like arranged core-parts are disassembled the coupling pieces are removed prior to the assembly of the inductive element from the core-parts i.e. rearranging the core-parts with their axes in parallel and abutting lateral contact surfaces. The coupling pieces can thereby be recycled and reused for other production runs.

The core-parts can have a central blind-hole in each of their front surfaces extending into longitudinal direction of the core-part and the coupling piece can comprise two projections with their longitudinal axes co-axially aligned. The projections thereby have a cross section in a plane perpendicular to the longitudinal direction that corresponds complementary to the cross section of the blind-holes of the core-parts. Preferentially, the projections and the blind-holes have complementary shapes and are both elongated in longitudinal direction.

The step of arranging a coupling piece between neighboring parts then preferentially comprises inserting one of the projections into the blind-hole of one of the neighboring core-parts and inserting the other projection into the blind-hole of another neighboring core-part.

In an exemplary embodiment, the coupling piece can be formed by a pin which is inserted into the blind-holes of the neighboring core-parts. The front surfaces of the neighboring core-parts then are in contact with each other and the pin serves as a mere centering piece. Such combined core-parts form a roll-shaft of good stability increasing reliability of the method of manufacture.

Alternatively, the front surfaces of the core-parts can also have further blind-holes which are formed off-center. A corresponding coupling piece then could have corresponding additional projections in order to prevent the core-parts from rotationally slipping with respect to each other due to exceedingly high torque. Insertion of the coupling piece into the blind-holes is then more complicated and assembly of the roll-shaft becomes complicated.

Other advantageous embodiments and combinations of features will be understood from the detailed description below and the totality of the claims.

BRIEF DESCRIPTION OF THE DRAWINGS

In the drawings used to explain the embodiments.

In the figures, the same components are given the same reference symbols.

DETAILED DESCRIPTION OF PREFERRED EMBODIMENTS

Figure 1A:
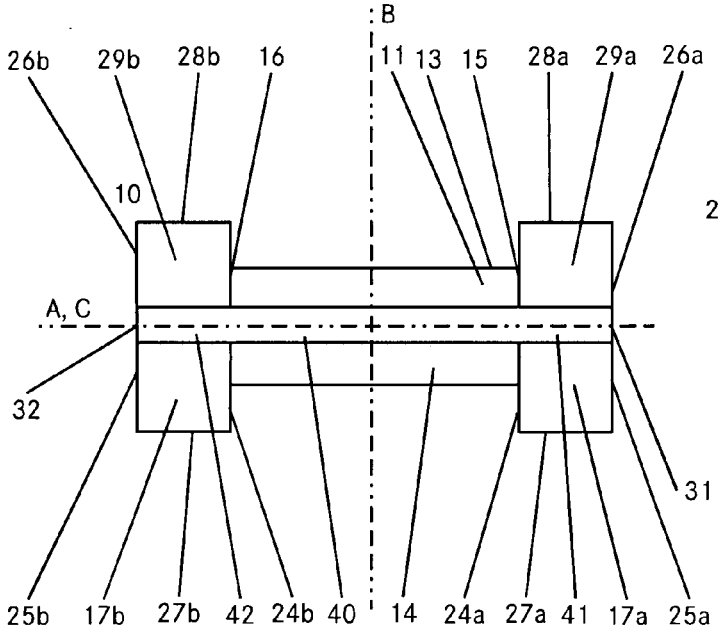
FIG. 1*a* shows an external top plan view of a core-part.
Figure 1B:
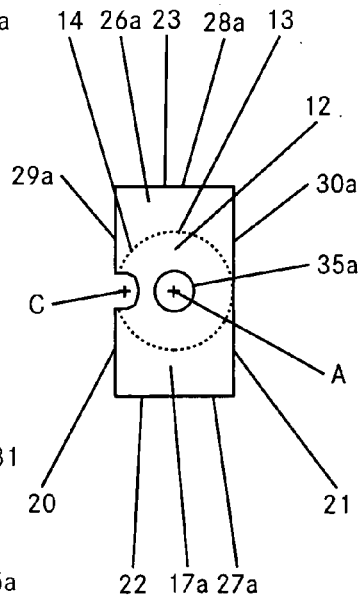
FIG. 1*b* shows an external end plan view of the core-part of FIG. 1*a;*

The embodiment of FIGS. 1*a* and 1*b* show a plan view of a core-part 10 of an inductive element according to the invention from two different directions. FIG. 1*a* shows the view perpendicular to a longitudinal axis A of the core-part 10 and FIG. 1*b* shows a view along the axis A.

The core-part 10 comprises an elongated cylindrical center piece 11 with its longitudinal axis co-axially aligned with the axis A. The center piece 11 has a circular cross section 12 and, with respect to the axis A, an outer (superficies) surface 13 forming a winding surface 14. The center piece 11 has at each of its longitudinal ends 15 and 16 a contact element 17*a* and 17*b*, respectively. The core-part 10 is symmetrically formed with respect to a plane B which is perpendicular to the longitudinal axis A and goes through the longitudinal middle of the center piece 11. The contact elements 17*a* and 17*b* are also symmetrically arranged with respect to the plane B. In other embodiments not shown here, the contact elements can also be asymmetrically arranged.

The contact elements 17*a* and 17*b* have both a cuboidal shape and a surface 24*a* and 24*b* of each cuboidal shape, respectively, is perpendicular to the axis A. The surface 24*a* abuts a frontal side at the longitudinal end 15 of the center piece 11 whereas the surface 24*b* abuts a frontal side at the longitudinal end 16 of the center piece. The contact elements 17*a* and 17*b* have further flat surfaces 25*a* and 25*b*, respectively, on the far side with respect to center piece 11, which are also perpendicular to the axis A. The surfaces 25*a* and 25*b* thereby form flat frontal contact surfaces 26*a* and 26*b*, respectively, of the core-part 10 at its corresponding longitudinal ends 31 and 32. The surfaces 24*a*, 24*b*, 25*a*, and 25*b* have a rectangular circumference in a plane parallel to B with longer 20 and 21, and shorter 22 and 23 sides. The length of the shorter sides 22 and 23 thereby essentially corresponds to the diameter of the circular cross section 12 of the center piece 11. The longer sides 20 and 21 are approximately twice as long as the shorter sides 22 and 23. The dimension of the contact elements 17*a* and 17*b* in a direction along the axis A approximately corresponds to the length of the shorter sides 22 and 23. The relative dimensions of the contact elements 17*a* and 17*b* can also be chosen differently and the shown embodiment represents only one possibility.

The contact elements 17*a* and 17*b* also have flat lateral contact surfaces 27*a* and 28*a* and 27*b* and 28*b*, respectively, which are formed by surfaces of the cuboidal shape. The lateral contact surfaces 27*a*, 27*b*, 28*a*, and 28*b* are parallel to each other and parallel to the axis A. The surfaces 27*a* and 27*b* and surfaces 28*a* and 28*b* lie pairwise in the same plane. Each pair of lateral contact surfaces 27*a* and 28*a*, and 27*b* and 28*b* are oppositely arranged with respect to the axis A. Each contact element 17*a* and 17*b* have further two surfaces which are parallel to the axis A. The further two surfaces 29*a* and 30*a* of the cuboidal contact element 17*a* together with the lateral contact surfaces 27*a* and 28*a* form an outer (superficies) surface of the contact element 17*a* with respect to the axis A. Correspondingly, the lateral contact surfaces 27*b* and 28*b* together with the surface 29*b* and a further surface, which is not shown in FIGS. 1*a* and 1*b*, of the cuboidal contact element 17*b* form an outer (superficies) surface of the contact element 17*b*.

The contact elements 17*a* and 17*b* further have each a central circular blind-hole in their frontal contact surfaces 26*a* and 26*b*. "Frontal," as used herein with respect to the surfaces 26*a* and 26*b*, means the exposed end surfaces of the core-part 10. Only one blind-hole 35*a* in the frontal contact surface 26*a* of contact element 17*a* is shown in the view FIG. 1*b* along the axis A facing the frontal contact surface 26*a*. A longitudinal axis of the bore forming the blind hole 35*a* corresponds to the axis A of the core-part 10. The diameter of the blind-hole 35*a* is about a third of the diameter of the cross-section 12 of the center piece 11. The depth in direction of A (not shown) of the blind-hole 35*a* is about 1 to 2 times its diameter. The values given here are understood as exemplary dimensions and can be chosen differently and according to the specific needs in other embodiments.

Further, the core-part 10 has a groove 40 which extends from the longitudinal end 31 to the other longitudinal end 32. The groove 40 is thereby formed in the winding surface 14 of the center piece 11 and extends in a portion 41 of the groove on surface 29*a* of contact element 17*a* and a portion 42 in the corresponding surface 29*b* of contact element 17*b*. A central longitudinal axis C of groove 40 thereby is arranged parallel to the longitudinal axis A of the core-part 10 and a plane containing axis A and axis C is parallel to the lateral contact surfaces 27*a*, 27*b*, 28*a* and 28*b*.

Figure 2:
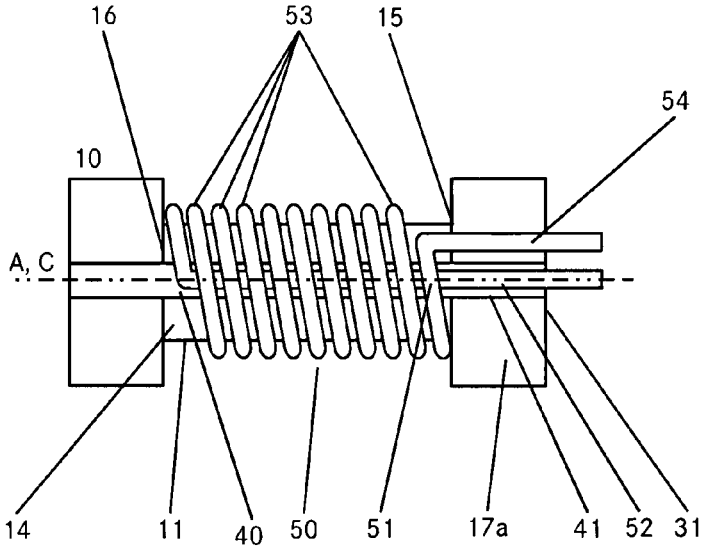
FIG. 2 shows an external top plan view of the core-part of FIGS. 1*a* and 1*b* with a winding.

FIG. 2 shows another embodiment of the core-part 10 with a winding 50 wound on it. The winding 50 comprises a wire 51. A portion 52 of the wire 51 is guided in longitudinal direction of axis A inside the groove 40 from the longitudinal end 31 to the far longitudinal end 16 of the center piece 11. At the longitudinal end 16 of the center piece 11, the wire 51 is lead in direction essentially perpendicular to the longitudinal axis A onto the winding surface 14. On the winding surface 14, the wire 51 is wound in helical turns 53 thus covering the wire end portion 52 inside the groove 40. With each of the turns 53 the wire 51 is lead toward the longitudinal end 15 at the contact element 17*a* of the center piece 11, where a second end portion 54 of the wire 51 is lead in longitudinal direction of axis A to the end 31 of the core-part 10. In the shown embodiment of the core-part 10 with a winding 50, both end portions 52 and 54 of the wire 51 are lead in parallel to the longitudinal end 31 of the core-part 10. Both end portions 52 and 54 thereby extend over the longitudinal end 31 in order to provide contact terminals for connecting the winding 50 to further electrical circuitry.

Figure 3:
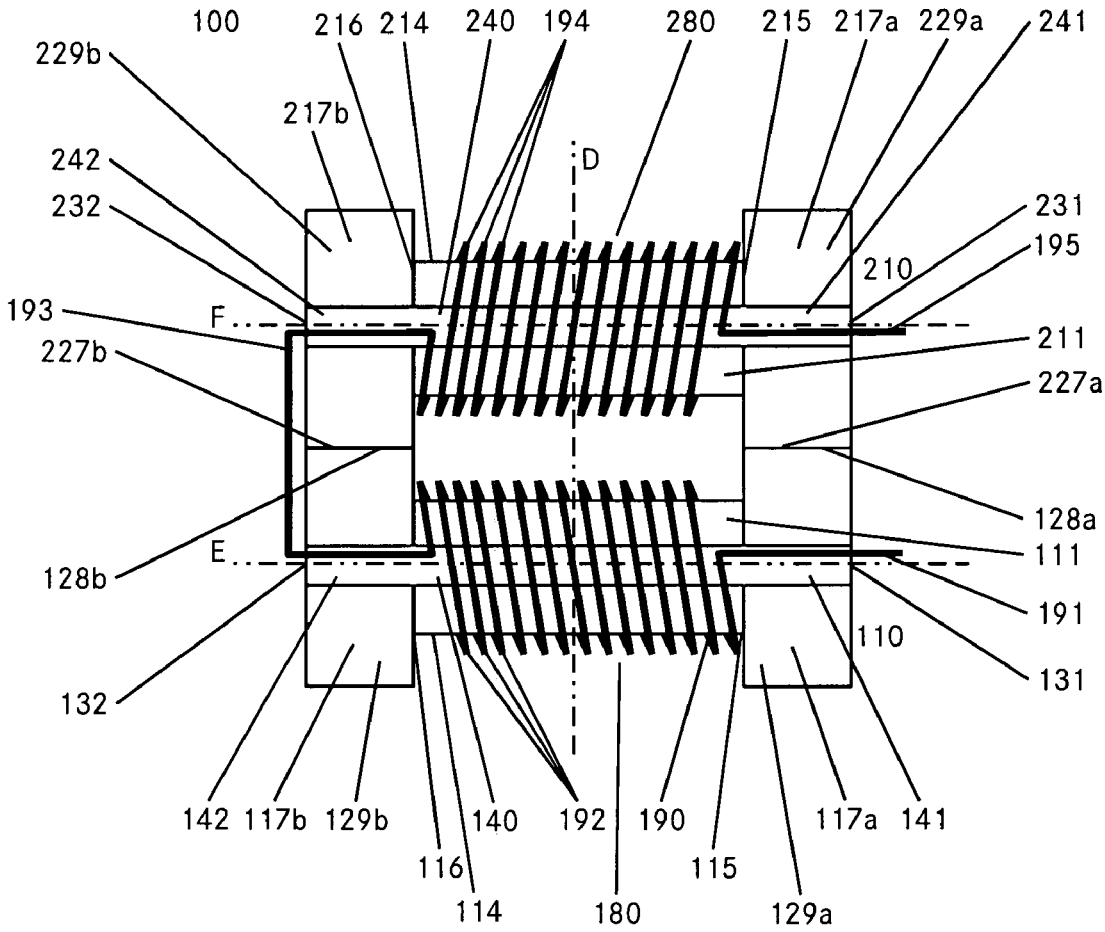
FIG. 3 shows an external top plan view of an inductive element according to the invention with two core-parts and two windings.

FIG. 3 shows an embodiment of an inductive element 100 according to the invention. The inductive element 100 comprises two core-parts 110 and 210 identical in construction with the core-part 10 of FIGS. 1*a*, 1*b* and 2. Reference numerals referring to elements of core-parts 110 and 210 which are identical to elements of core-part 10 have a value 100 and 200 higher, respectively, for example, center piece 111 of core-part 110 and center piece 211 of core-part 210 (corresponding to center piece 11 of core-part 10).

The inductive element 100 comprises a stack arrangement of the two core-parts 110 and 210. Each core-part 110 and 210 has contact elements 117*a* and 117*b*, and 217*a* and 217*b*, respectively. Both core-parts 110 and 210 are symmetrically formed with respect to a plane D which is perpendicular to longitudinal axes E and F of core-parts 110 and 210 (corresponding to axis A of core-part 10) and which goes through the longitudinal middle of the center pieces 111 and 211.

The core-parts 110 and 210 are arranged in a way that lateral contact surfaces 128*a* and 128*b* of core-part 110 abut on lateral contact surfaces 227*a* and 227*b* of core-part 210, respectively. The axes E and F of the core-parts 110 and 210 are thereby arranged in parallel.

The core-part 110 has a wire winding 180 and the core-part 210 has a wire winding 280 wound onto their winding surface 114 and 214, respectively. The windings 180 and 280 have oppositely defined winding senses. In the representation of FIG. 3, the windings 180 and 280 are connected in series. The windings 180 and 280 are shown as schematic lines in order to illustrate their run on the core-parts 110 and 210.

A first end portion 191 of a wire 190 of the winding 180 is guided inside a portion 141 of a groove 140 from a longitudinal end 131 of core-part 110 to the winding space 114. The portion 141 of the groove 140 is formed in a surface 129*a* of the contact element 117*a*. The groove 140 thereby extends from one longitudinal end 131 of the core-part 110 to the other longitudinal end 132 in direction of the axis E. At a longitudinal end 115 of the center piece 111, the wire 190 is lead onto the winding surface 114. On the winding surface 114, the wire 190 is wound in helical turns 192. With each turn 192, the wire 190 is lead to the opposite longitudinal end 116 of the center piece 111. At the longitudinal end 116, the wire 190 is lead into a portion 142 of the groove 140, which is formed in a surface 129*b* of the contact element 117*b*. The wire 190 is guided inside the portion 142 from the winding surface 114 to the longitudinal end 132 of the core-part 110.

A portion 193 of the wire 190 is lead from the portion 142 of the groove 140 to a longitudinal end 232 of core-part 210, where it is lead into a portion 242 of a groove 240 of core-part 210. The groove portion 242 is formed in a surface 229*b* of the contact element 217*b* of core-part 210. The wire 190 is guided inside the groove portion 242 to the winding surface 214 where it is lead at the longitudinal end 216 of the center piece 211 onto the winding surface 214 in order to form the winding 280. On the winding surface 214, the wire 190 is wound in helical turns 194. With each turn 194, the wire 190 is lead to the opposite longitudinal end 215 of the center piece 211. At the end 215 of the center piece 211 the wire 190 is lead into a groove portion 241 in a surface 229*a* where it is guided to a longitudinal end 231 of core-part 210. A wire portion 195 extends beyond the longitudinal end 132.

Figure 4:
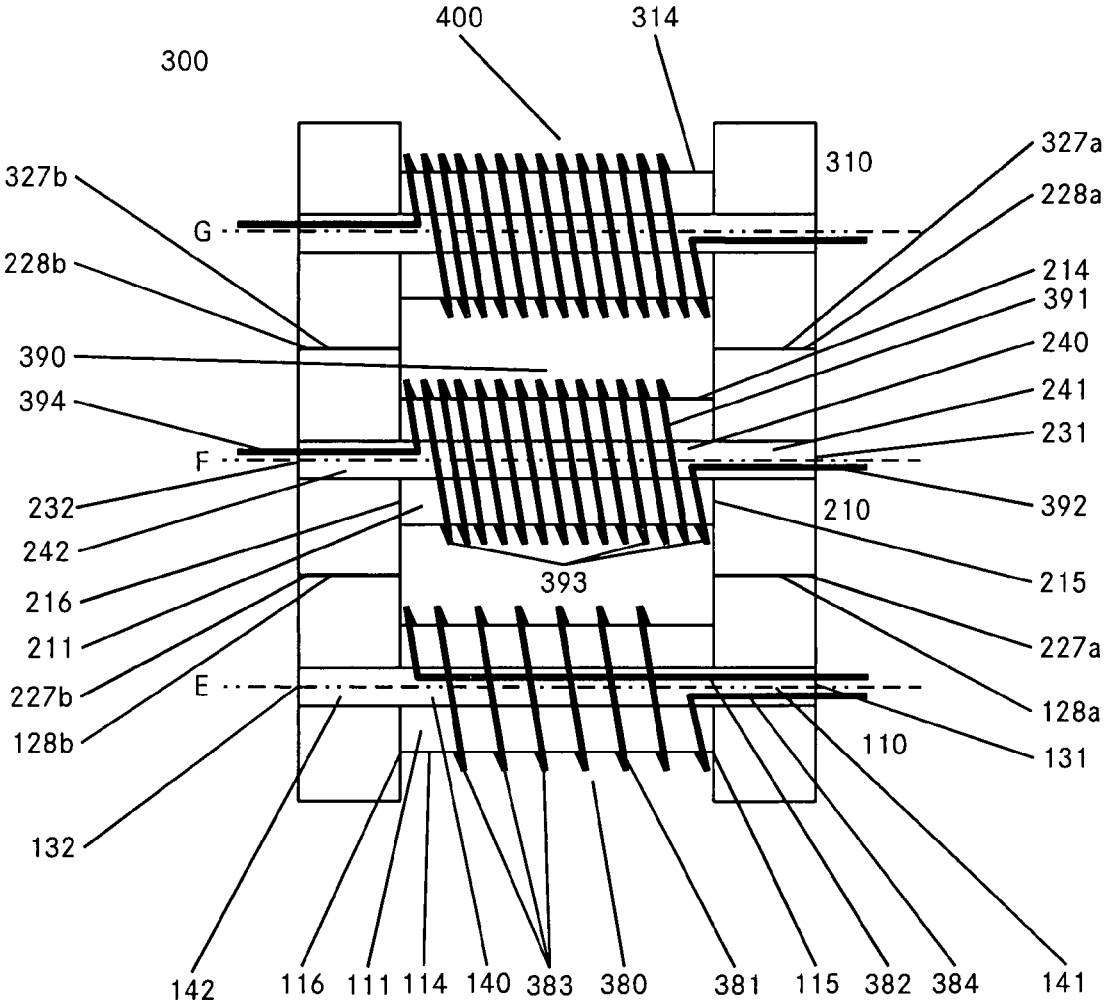
FIG. 4 shows an external top plan view of an inductive element according to the invention with three core-parts and three windings.

FIG. 4 shows another embodiment of an inductive element 300 according to the invention. The inductive element 300 comprises three core-parts 110 and 210 and 310 which are identical in construction with the core-part 10 of FIGS. 1*a*, 1*b* and 2. As in the above, reference numerals referring to parts of core-parts 310 which are identical to parts of core-part 10 have a value 300 higher.

Core-parts 110 and 210 are arranged as in the arrangement shown in FIG. 3. In addition, the third core-part 310 is arranged in a manner that lateral contact surfaces 228*a* and 228*b* of core-part 210 abut on lateral contact surfaces 327*a* and 327*b* of core-part 310, respectively. A longitudinal axis G of core-part 310 is thereby arranged in parallel with the axes E and F of core-parts 110 and 210. All three core-parts 110, 210, and 310 thus form a straight stack with axes E, F and G lying in the same plane.

Core-parts 110, 210, and 310 have windings 380, 390, and 400, respectively, wound onto winding surfaces 114, 214, and 314. The schematic representation of winding 380 on core-part 110 thereby corresponds to a schematic representation of winding 50 shown in FIG. 2. The winding 380 comprises a wire 381. A portion 382 of the wire 381 is guided in longitudinal direction E of the core-part 110 inside the groove 140 from the longitudinal end 131 of the core-part 110 to the far longitudinal end 116 of the center piece 111. At the longitudinal end 116, the wire 381 is lead in direction essentially perpendicular to the longitudinal axis E onto the winding surface 114. On the winding surface 114, the wire 381 is wound in helical turns 383 thus covering the wire portion 382 inside the groove 140. With each of the turns 383 the wire 381 is lead toward the longitudinal end 115 of the center piece 111, where a second end portion 384 of the wire 381 is lead in longitudinal direction of axis E to the end 131 of the core-part 110.

A first end portion 392 of a wire 391 of the winding 390 is guided inside a portion 241 of a groove 240 from the longitudinal end 231 of core-part 210 to the winding space 214. At the longitudinal end 215 of the center piece 111, the wire 391 is lead onto the winding surface 214. On the winding surface 214, the wire 391 is wound in helical turns 393. With each turn 393, the wire 391 is lead to the opposite longitudinal end 216 of the center piece 211. At the longitudinal end 216, the wire 391 is lead into the portion 242 of the groove 240. The wire 391 is guided inside the portion 242 from the winding surface 214 to the longitudinal end 232 of the core-part 210 and a wire portion 394 extends over the core-part 210 in longitudinal direction F.

Core-part 310 has a winding 400 that corresponds to the winding 390 of core-part 210.

Figure 5:
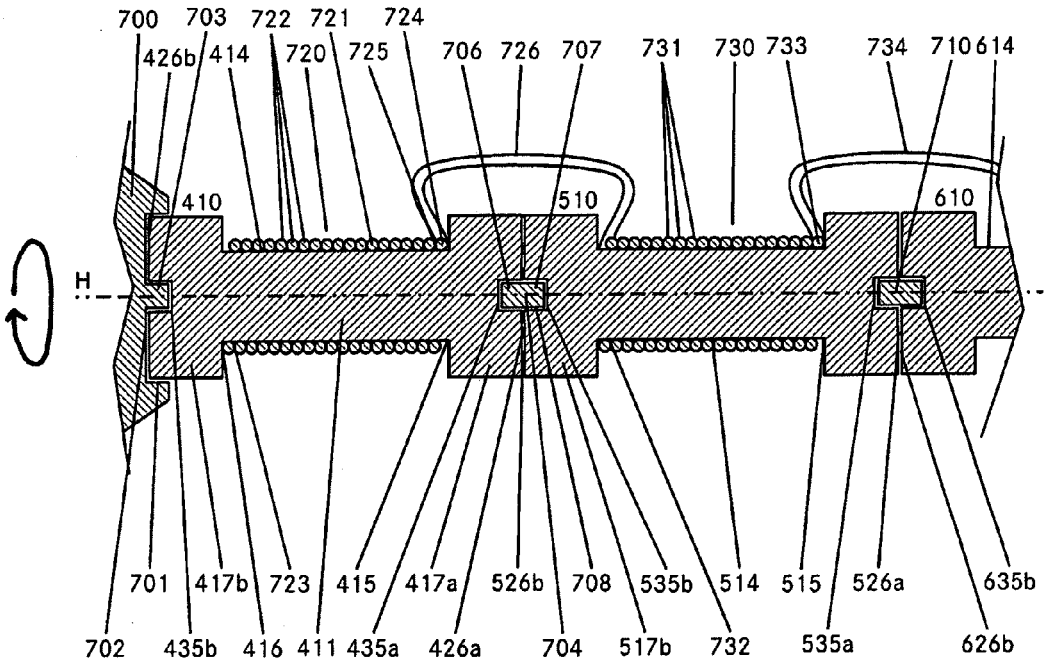
FIG. 5 is a fragmentary sectional view of core-parts being arranged co-axially according to the method of the invention.

FIG. 5 shows a sectional view of core-parts in a co-axial arrangement according to the method of manufacture of an inductive element according to the invention. Three core-parts 410, 510 and 610 are displayed with core-part 610 only in partial view. Each core-part 410, 510, and 610 is identical in construction with the core-part 10 of FIGS. 1*a*, 1*b* and 2. As in the above, reference numerals referring to elements of core-parts 410, 510 and 610 which are identical to elements of core-part 10 have a value 400, 500 and 600 higher, respectively.

The core-parts 410, 510, and 610 have each a longitudinal axis which is co-axially aligned with an axis H. The core-parts 410, 510, and 610 are arranged next to each other wherein core-part 410 is next to core-part 510 which in turn is next to core-part 610.

A contact element 417*b* of core-part 410 thereby is held in a socket 700 which can be a part of a winding machine (not shown). In a possible embodiment, the socket 700 can be a three jaw chuck or equivalent as is known from lathes or drilling machines. In the representation of FIG. 5, the socket 700 has a receiving space 701 complementary to a longitudinal end portion of the contact element 417*b*. The receiving space 701 has a contact surface 702 which is perpendicular to axis H and complementary to a contact surface 426*b* of contact element 417*b*. The core-part 410 is arranged with its contact element 417*b* in the receiving space 701 of socket 700. The contact surface 426*b* then abuts on the contact surface 702 of socket 700 and the socket 700 partially encompasses the contact element 417*b*. Thereby, the contact element 417*b* is held in the socket 700 in order to prevent longitudinal or radial movement with respect to axis H. In addition, the contact surface 702 has a circular cylindrical projection 703 which is also arranged co-axially with axis H. The projection 703 thereby is arranged inside a blind-hole 435*b* which is formed centered on the contact surface 426*b*.

A frontal contact surface 526*b* of contact element 517*b* of core-part 510 abuts on a frontal contact surface 426*a* of a contact element 417*a* of core-part 410. In the embodiment shown in FIG. 5, the core-parts 410 and 510 have a coupling piece 704 arranged between them. The coupling piece 704 thereby has a section 706 corresponding to a blind-hole 435*a* of core-part 410 and a section 707 which corresponds to a blind-hole 535*b* of core-part 510. Since both blind-holes 435*a* and 535*b* are formed correspondingly, the coupling piece 704 is an elongated pin 708, and, in the arrangement shown, is fully inserted into the blind-holes 435*a* and 535*b*. In the arrangement of FIG. 5 the contact surfaces 426*a* and 526*b* are in full contact with each other.

The core-part 610 is arranged with respect to core-part 510 corresponding to the arrangement of core-part 510 with respect to core-part 410. Contact surfaces 526*a* and 626*b* are abutting on each other, and a coupling piece 710 corresponding to coupling piece 704 is arranged in blind-holes 535*a* and 635*b*.

The core-part 410 has a winding 720. The winding 720 comprises a wire 721 which is wound in helical turns 722 onto the winding surface 414 of a center piece 411. The winding starts in a region 723 of the winding surface 414 at a longitudinal end 416 of the center piece 411. At an end portion 724 of the winding 720, which is in a region 725 at a longitudinal end 415 of the center piece 411, a portion 726 of the wire 721 is lead to a region 732 of the winding surface 514 of core-part 510.

The wire 721 continues from the region 732 on the winding surface 514 in helical turns 731, thus forming a winding 730 of core-part 510. At an end portion 733 of the winding 730 at a longitudinal end 515 of the winding surface 514, a portion 734 of the wire 721 is lead from the winding surface 514 to a winding surface 614 of core-part 610.

Figure 6:
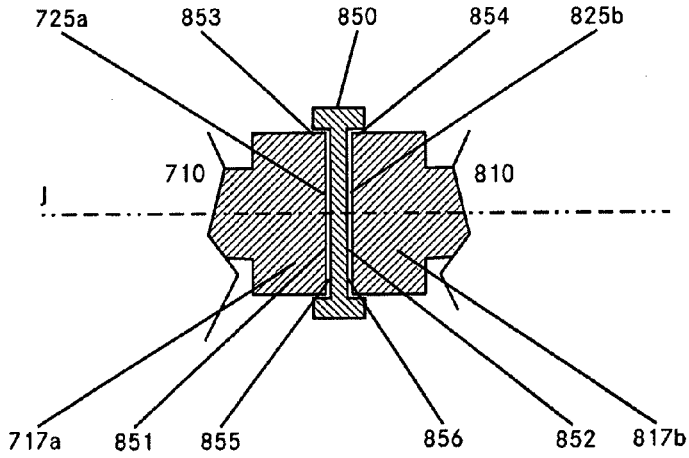
FIG. 6 is a fragmentary sectional view of two contact elements of two co-axially arranged core-parts with a coupling piece.

A sectional view of another co-axial arrangement of two core-parts 710 and 810 is shown in FIG. 6. As in the above, reference numerals referring to elements of core-parts 710 and 810 which are identical to elements of core-part 10 have a value 700 and 800 higher, respectively. The core-parts 710 and 810 essentially correspond to core-part 10 without having blind-holes in frontal contact surfaces 725*a* and 825*b* of contact elements 717*a* and 817*b*, respectively. The core-parts 710 and 810 have a common longitudinal axis J. A coupling piece 850 is interposed in longitudinal direction between the front surfaces 725*a* and 825*b*. The coupling piece 850 has two receiving spaces 851 and 852 which correspond complementary to longitudinal end portions 853 and 854 of the contact element 717*a* and 817*b*, respectively. Each receiving space 851 and 852 has a contact surface 855 and 856 which abuts on the frontal contact surfaces 725*a* and 825*b*, respectively, and the receiving spaces 851 and 852 of the contact elements 717*a* and 817*b* partially encompass the end portions 853 and 854 of core-parts 710 and 810.

In summary, it is to be noted that the invention offers an efficient inductive element and a simple and efficient method of manufacture for an inductive element.

The invention is not restricted to the special embodiments described above. In contrast to the embodiments shown, the contact elements can also be asymmetrically arranged with respect to a plane which is perpendicular to the longitudinal axis of a center piece and which goes through the longitudinal middle of the center piece. Within the framework of the invention, the contact elements of a core-part can be arbitrarily and independently shaped.

The core-parts also can have more than one blind-hole in a frontal contact surface. Also, the cross-section of the blind-holes can be multi-edged or elliptical or can have any other form suitable for receiving corresponding projections of a coupling piece.

In order to ensure efficiency of the inductive element, the length of the blind-holes in longitudinal direction should be chosen as short as possible in order to minimize perturbation of the magnetic flux-path inside the core-part.

Coupling pieces can also be formed differently than described above and do not necessarily require blind-holes in the core-parts. Without having projections that can be inserted into blind-holes of the core-parts, coupling pieces can perform their coupling function by encompassing abutting contact elements of neighboring core-parts and thereby maintaining the co-axial arrangement. The coupling pieces thereby can have receiving spaces for the contact elements of the core-parts (see FIG. 6). It is also possible that no coupling pieces are needed for maintaining the co-axial arrangement of core-parts during manufacture. It is possible, that only friction between the frontal contact surfaces and pressure exerted in longitudinal direction of the co-axially arranged core-parts may be responsible for maintaining the shaft-like arrangement.

The arrangement shown in FIG. 5 is exemplary and can be altered in many ways. In particular, many more core-parts can be co-axially arranged and the wire can be continuously led from one winding surface to another. Also, the wire cannot only be lead from one core-part to only a neighboring core-part; it is possible that the wire is lead to second and third neighbors. Thereby, complicated interconnections between windings of the resulting inductive elements can be achieved.

Further, the core-parts and contact elements can comprise more than one groove or recess, respectively. In another embodiment, it is possible that one contact element has two groove portions or recesses which extend in longitudinal direction in order to guide more than one portion of a winding to the winding space or from the winding space to a longitudinal end of the core-part. Instead of recesses, the end portions of wires can also be lead through through-holes in the contact elements to winding surfaces. Further, it is also possible that the winding surface of a center piece has more than one groove.

While preferred exemplary embodiments of the invention have been illustrated and described, these are not to be taken as limiting upon the spirit and scope of the invention as set forth in the appended claims, as further modifications and additions within the invention as claimed will be apparent to those skilled in the art.

We claim:

1. A method of manufacture of an inductive element comprising providing at least two separate core-parts of magnetically permeable material with each having an elongated center piece with an outer winding surface, comprising the steps of:

a) arranging the separate core-parts adjacent to each other with their longitudinal axes substantially co-axially aligned;

b) rotating the separate core-parts together along the longitudinal axes; and c) performing a winding process in which an electrical conductor is wound on the winding surfaces of at least two separate core-parts.

2. The method of manufacture of an inductive element according to claim 1, wherein the electrical conductor is continuous and the winding process further comprises:

d) in step (c) winding the winding from the electrical conductor directly onto the winding surface of a core-part;

e) leading the same electrical conductor to the winding surface of another core-part; and f) continuing winding the electrical conductor on the winding surface of the other core-part.

3. The method of manufacture of an inductive element according to claim 1, wherein the winding process comprises the step of leading the electrical conductor inside a longitudinal groove in a winding surface of one of the core-parts from at least proximate one longitudinal end to at least proximate the other longitudinal end of the groove.

4. The method of manufacture of an inductive element according to claim 1, further comprising providing each core-part with a contact element at each of the opposite longitudinal ends of its center piece, each contact element having lateral contact surfaces formed on an outer surface of the contact element relative to the longitudinal axis of the core-part and, after the step of performing the winding process, the method comprises the further steps of arranging the core-parts with their longitudinal axes substantially parallel, such that the contact surface of each contact element abuts on a lateral contact surface of another core-part.

5. The method of manufacture of an inductive element according to claim 1, wherein the step of arranging the core-parts with their longitudinal axes substantially co-axially aligned comprises arranging neighboring core-parts with facing frontal surfaces abutting on each other.

6. The method of manufacture of an inductive element according to claim 1, wherein the step of arranging the core-parts with their longitudinal axes substantially co-axially aligned comprises the further step of arranging a coupling piece between neighboring core-parts to mechanically couple the separate core-parts together.

7. The method of manufacture of an inductive element according to claim 6, wherein the step of arranging the coupling piece between neighboring core-parts comprises inserting a projection of the coupling piece into a longitudinal hole in a facing surface of one of the two neighboring core-parts and inserting another projection of the coupling piece into a hole in a facing surface of the other one of the neighboring core-parts.

8. The method of manufacture of an inductive element according to claim 6, wherein the step of arranging the coupling piece between neighboring core-parts comprises inserting an end of one of the neighboring core-parts in a conforming recess on one side of the coupling piece and inserting an end of another of the neighboring core-parts in a conforming recess on an opposite side of the coupling piece.

9. The method of manufacture of an inductive element according to claim 1, wherein the step of arranging the at least two separate core-parts next to each other comprises the step of arranging at least one further separate core-part having an elongated center piece with an outer winding surface next to one of the at least two core-parts with its longitudinal axis substantially co-axially aligned with the longitudinal axes of the at least two core-parts, whereby a total of at least three core-parts are thus arranged.

* * * * *